United States Patent [19]

Suppa

[11] 4,380,440

[45] Apr. 19, 1983

[54] DROPPABLE AIRBORNE BUOY

[75] Inventor: Vito Suppa, Paris, France

[73] Assignee: Thomson-CSF, Paris, France

[21] Appl. No.: 181,650

[22] Filed: Aug. 26, 1980

Related U.S. Application Data

[63] Continuation-in-part of Ser. No. 57,422, Jul. 13, 1979, Pat. No. 4,279,025.

[30] Foreign Application Priority Data

Aug. 28, 1979 [FR] France ..... 79 21562

[51] Int. Cl.[3] ..... B63B 21/52

[52] U.S. Cl. ..... 441/30; 244/138 R; 367/3

[58] Field of Search ..... 367/3, 4; 244/138 R; 89/1.5 D, 1.5 A; 102/348, 351, 354, 386, 390, 396, 405; 441/30

[56] References Cited

U.S. PATENT DOCUMENTS

| | | | |
|---|---|---|---|
| 3,234,503 | 2/1966 | Wojciechowski et al. | 9/8 R |
| 3,889,224 | 6/1975 | Reed et al. | 9/8 R |
| 4,215,836 | 8/1980 | Zacharin | 244/138 R |
| 4,279,025 | 7/1981 | Suppa | 244/138 R |

*Primary Examiner*—Sherman D. Basinger

*Attorney, Agent, or Firm*—Oblon, Fisher, Spivak, McClelland & Maier

[57] ABSTRACT

An airborne buoy droppable from an aircraft into water, comprising, as a float, a balloon which inflates during its fall. Before being dropped the balloon is protected by a hood locked by a bent blade bearing on a wedge. During the fall, the scoop-shaped mechanical parts lift up, a cloth placed below an opening in the scoops inflates and frees the hood by drawing back the wedge fixed on the tongue forming an extension of the cloth.

3 Claims, 3 Drawing Figures

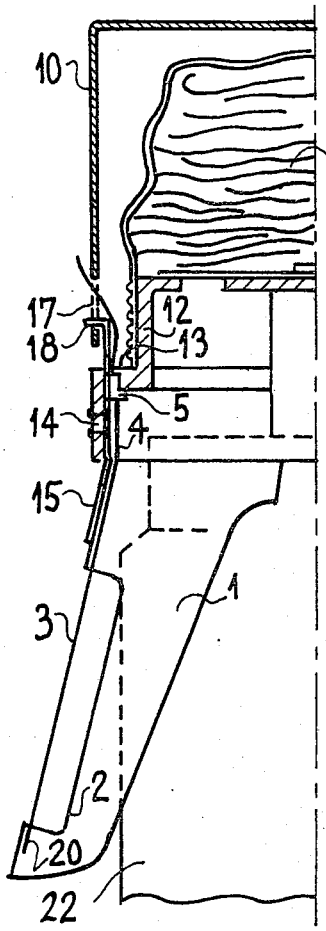
FIG_1(a)
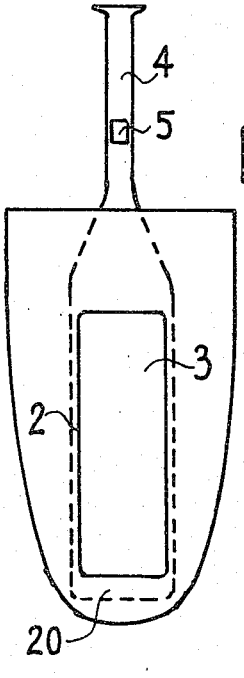
FIG_1(b)
FIG_2
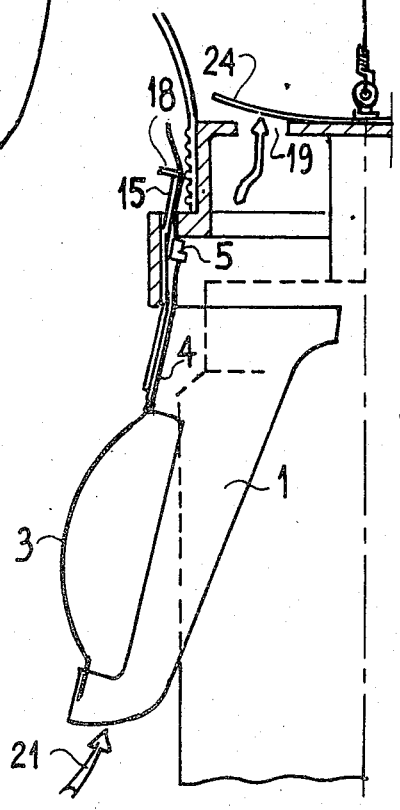

DROPPABLE AIRBORNE BUOY

BACKGROUND OF THE INVENTION

The present invention relates to improvements relative to airborne buoys dropped in water which comprise a balloon as a float, and is a Continuation-In-Part of U.S. Application Ser. No. 57,422 filed July 13, 1979 and now U.S. Pat. No. 4,279,025.

This balloon is inflated during its fall and once on the water, the air is imprisoned in the balloon and ensures floatation of the buoy when the balloon has reached the water. Before the buoy is brought into use, the balloon is protected and maintained folded by a cylindrical-shaped hood forming an extension of the body of the buoy. This hood must be separated at the beginning of the fall through the air of the buoy just after it has been dropped from an aircraft. Inflation of the balloon is effected by a forced-air input situated at the base of the balloon, and formed of curved mechanical parts or "scoops" allowing the intake of the air. The scoops actuate mechanisms when they lift up on dropping the buoy which, in particular, free the protecting hood of the balloon.

SUMMARY OF THE INVENTION

The purpose of the present invention is avoiding, before the buoy is brought into use, accidental release of the hood by lifting up of the scoops.

Briefly, the invention is a buoy capable of being dropped by an aircraft into water, wherein each of the scoops comprises a window covered on the inside with a flexible cloth which is inflated when the scoops lift up and actuates a mechanism for releasing the protecting hood of the balloon.

DESCRIPTION OF THE DRAWINGS

Other characteristics and advantages will appear from the description of one example of the invention, given with reference to the figures wherein:

FIGS. 1*a* and 1*b* are respectively views in semi-section and from the side of a droppable buoy in accordance with the invention;

FIG. 2 is a view of this buoy during its fall.

DESCRIPTION OF THE PREFERRED EMBODIMENT

FIG. 1*a* shows a cross-section of half of the upper part of the buoy before it is dropped and FIG. 1*b* the side view thereof. There can be seen the hood 10 protecting the folded balloon 11 which is fixed to a connecting piece 12. This piece comprises a shoulder 13 extended by a part 14.

According to a feature of the invention the two scoops 1 each include a recess forming a window 2, for example rectangular, fitted with a flexible cloth 3 covering it entirely over its inner face. This cloth is fixed to the base 20 of the window and it is extended upwardly by a tongue 4.

The scoops are hinged to the part 14 of the buoy by means of a resilient blade 15 forming a hinge (in FIG. 1*a* the scoop is lifted up). Shoulder 13 includes, at the level of the axis of symmetry of each scoop, a recess. Blade 15 is maintained rigidly on part 14 above the rotational axis of the scoops. This blade is extended so as to pass into this recess in order that its upper part 18, bent at a right-angle, may lock the hood by penetrating into an aperture 17. Locking is obtained by a piece 5, or wedge, connected rigidly to the cloth tongue 4 passing through the recess, and which maintains in position the upper part of blade 15, forming a spring bearing against wall 14. Thus, since the tongue passes very close to the hinge it is not subjected to any pull, during opening of the scoops. In accordance with another embodiment, the two parts of blade 15 forming respectively a hinge for the scoops and a spring for locking the hood, are separated.

FIG. 2 shows a cross-section of half of the upper part of the buoy after it has been dropped. With the buoy released for example from an aircraft, the air symbolized by arrow 21 rushes under the scoops 1 causing them to lift up and, simultaneously, causes inflation of cloth 3 in the manner of a parachute, through window 2. This inflation leads to a downwardly exerted force sufficient to release wedge 5 allowing blade 15 to return to its rest position and the curved parts 18 to be withdrawn from apertures 17 of the hood which is freed. The balloon may then be inflated by the air entering by holes 19, after blade 24 has lifted up.

The cloth is manufactured, for example, from a resistant and impermeable polyamide material, and wedge 5 is made from a hard plastic material which is welded to this cloth by heating. In accordance with this process, the hood can only be freed by a thrust exerted on the cloth from underneath the scoops. Furthermore, the cloth cannot be torn away accidentally from the outside, this cloth being on the one hand situated inside the window and, on the other hand, pressed against the wall of the body 22 of the buoy.

What is claimed is:

1. A buoy capable of being dropped onto water from an aircraft, comprising: an inflatable balloon attached to a container; said balloon being inflated during its descent by a forced intake of air at the base thereof; said buoy having adjustable openings in the form of scoops; said forced intake of air taking place through the opening of these scoops; each of said scoops comprising a window covered inside by a flexible cloth; said cloth being inflated when the scoops lift up during the drop of said buoy; said cloth actuating a freeing mechanism for releasing a protecting hood capping said balloon.

2. A buoy as claimed in claim 1, wherein said freeing mechanism comprises a tongue forming an extension of said cloth; said tongue passing along a flexible blade forming a hinge for each of said scoops; there being fixed on said blade a wedge which bears on a locking blade forming a spring, one bent end of which serves for locking said hood before inflation of said cloth.

3. A buoy as claimed in claim 2, wherein said locking blade and said hinge are made from the same piece.

* * * * *